United States Patent [19]

Lin

[11] Patent Number: 4,943,232

[45] Date of Patent: Jul. 24, 1990

[54] IGNITION DEVICE FOR A GAS BURNER

[76] Inventor: Whang-Tung Lin, Fl. 2, No. 291-1, Pei-Tun Rd., Taichung City, Taiwan

[21] Appl. No.: 469,133

[22] Filed: Jan. 24, 1990

[51] Int. Cl.[5] ..... F23Q 3/00

[52] U.S. Cl. ..... 431/263; 431/264; 126/41 R

[58] Field of Search ..... 431/255, 263, 264, 266; 126/41 R

[56] References Cited

U.S. PATENT DOCUMENTS 4,266,930 5/1981 Leonard et al. ..... 431/263

4,861,264 8/1989 Romanak et al. ..... 431/263

*Primary Examiner*—Carroll B. Dority

*Attorney, Agent, or Firm*—Knobbe, Martens, Olson & Bear

[57] ABSTRACT

An ignition device for a gas burner having a burner casing with at least one flange member outwardly and radially extending from the burner casing, and a plurality of flame holes below the flange member includes an electrode, a spark generator for inducing a spark in the electrode, a housing for the electrode and fastening means for fixing said housing to the gas burner. The fastening means makes it easier to attach and detach the ignition device to the burner. The fastening means is adjustable, allowing the ignition device to be compatible with gas burners of various shapes and sizes.

7 Claims, 3 Drawing Sheets

IGNITION DEVICE FOR A GAS BURNER

BACKGROUND OF THE INVENTION

This invention relates to an ignition device for a gas burner, more particularly to an ignition device for a barbecue grill which is easily adjustable and detachable from the gas burner.

The ignition device of a barbecue grill basically comprises an electrode connected to a spark generator. FIG. 1 shows a main housing 10 containing a gas burner 12 having a plurality of flame holes 121, and an endless flange member 122 surrounding the gas burner 12. The flange member 122 prevents oil from dripping into the flame holes 121. An electrode 14 is housed inside a collector box 13 which is mounted on the main housing 10. The top plate of the collector box 13 is at level with the flame holes 121. A main drawback of this structure is when the ignition device is damaged. In this case, it would be difficult to replace the damaged parts because the collector box 13 is fixedly mounted to the main housing 10. The positioning of the electrode 14 with respect to the flame holes 121 also has to be considered, since if the electrode 14 is placed too far from the flame holes 121, combustion time will take longer, thus making the barbecue grill less efficient.

FIG. 2 shows a perspective view of an inverted barbecue grill burner with another example of an ignition device. The electrode tip 141 is fixed to the rear of burner 12 by a locking member 21 which is screwed to burner 12. The electrode tip is distanced from the flame holes 121 by about ¼ inch for ignition efficiency. As with the above example, replacement is not easy because the electrode tip 141 must not be fixed too near nor too far from the flame holes 121.

SUMMARY OF THE INVENTION

It is therefore a main object of this invention to provide an ignition device for the gas burner of a barbecue grill which is easily replaceable when said ignition device is damaged.

Another object of this invention is to provide an ignition device which can be adapted to fit a wide range of barbecue grill burners.

Accordingly, an ignition device of this invention comprises an electrode, a spark generator, a housing means and an adjustable fastening means for fixing the housing to the gas burner.

Specifically, the adjustable fastening means comprises two strip members, each having an arched end, and a screw holding and sleeve member. One strip member is welded onto the screw holding and sleeve member, while the other is sleeved onto the same. The two strip members are clamped opposite each other to the flange member of the barbecue grill, with a screw fastening the two strip members in this position.

Since the ignition device comes in a package, should any of the parts become damaged, replacement is simply done by replacing the entire device.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
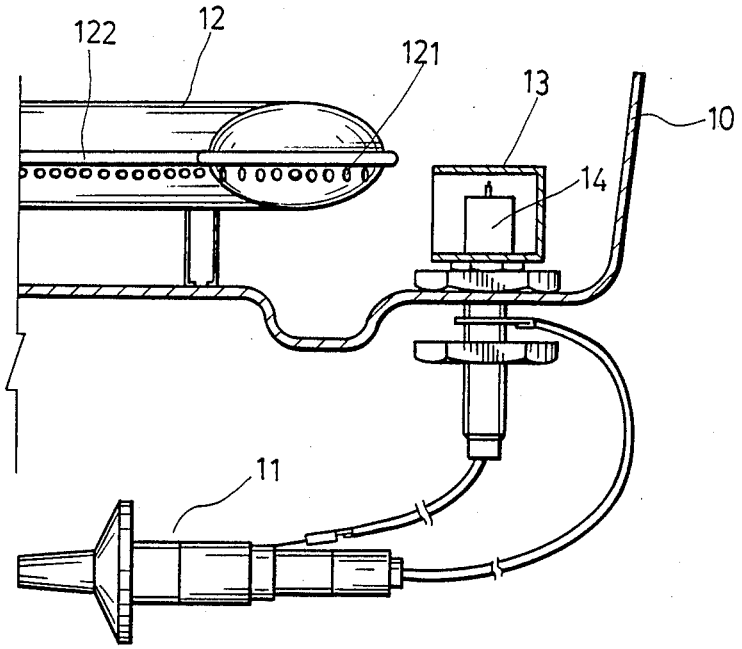
PRIOR ART FIG.1
FIGS. 1, 2 are illustrations of prior art.
Figure 2:
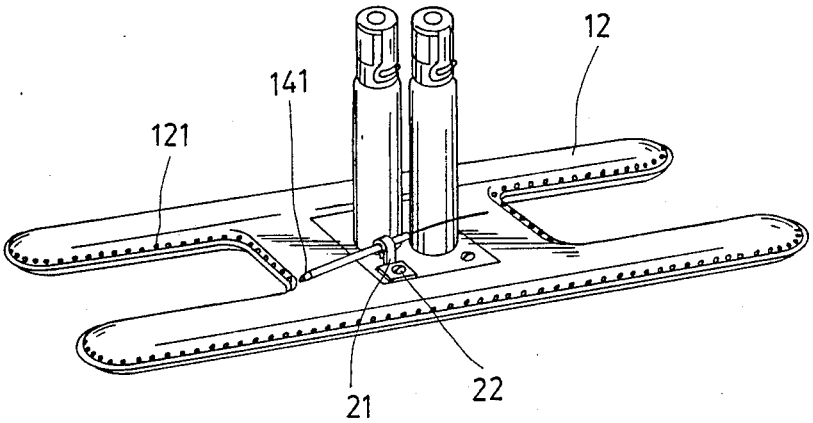
PRIOR ART FIG.2
Figure 3:
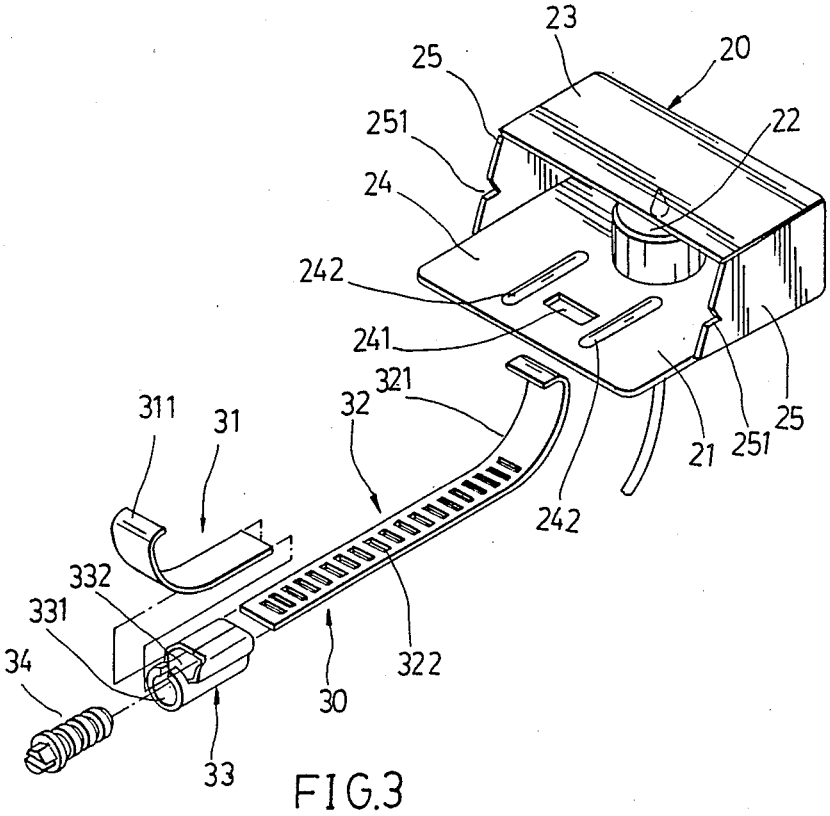
FIG. 3 is an exploded perspective view of the preferred embodiment according to this invention.

Referring to FIG. 3, a housing 20, which is substantially shaped as a box, comprises a thin rectangular bottom plate 21 with an electrode 22, which has an electrode tip 221 mounted therein; a top plate 23 parallel to the rectangular bottom plate 21; a pair of side plates 25 substantially having a trapezoidal form; and a rear closed end opposed to a front open end. The electrode tip 221 is distanced from the top plate 23 by approximately ¼ inch for ignition efficiency. At this distance, the housing 20 collects gas from the flame holes of the gas burner and the effect is similar to that of the electrode tip being spaced by ¼ inch from the flame holes. The rectangular bottom plate 21 has an extended portion 24 extending a short distance away from the open end. A longitudinally extending rectangular slot 241 and a pair of transverse reinforcing protrusions 242 are in the extended portion 24. The reinforcing protrusions 242 strengthen the structure of the thin rectangular bottom plate 21. A V-shaped notch 251 is formed along the inclined edge of each side plate 25.

Figure 4:
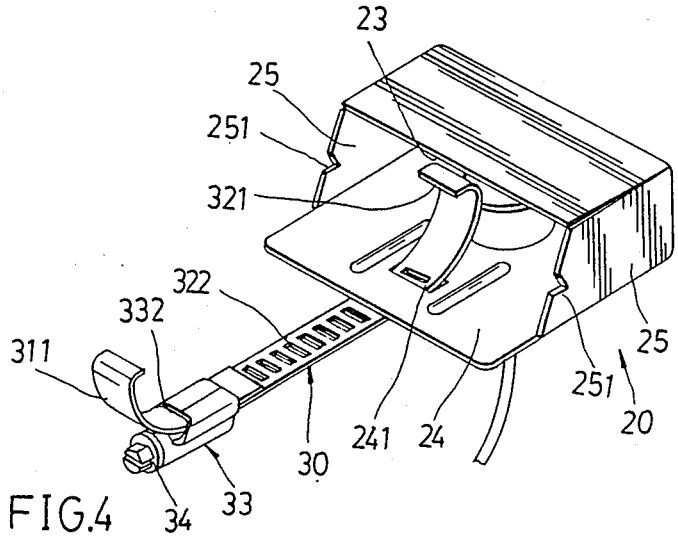
FIG. 4 is an illustration showing assembly.

The fastening means 30 comprises of a first strip member 31 and a second strip member 32. The first and second strip members 31, 32 are shaped as elongated flat bars having arched ends 311, 321, respectively. A plurality of spaced transverse slots 322 are aligned along the non-arching portion of second strip member 32. An adjusting member 33 includes a screw housing 331 substantially cylindrical in shape and connected along a common wall to a strip housing 332 which is substantially rectangular in shape. The screw housing 331 is communicated to the sleeve housing 332 via an axial opening formed along the common wall. The non-arching portion of the first strip member 31 is welded to the inner surface opposite the axial opening of the sleeve housing 332. The second strip member is sleeved onto sleeve housing 332. A screw member 34 is disposed inside the screw housing portion 331. The screw member 34 communicates with the slots 322 of second strip member 32 to fasten the two strip members 31, 32 in a fixed position. FIG. 4 illustrates how the second strip member 32 is connected to the housing 20. In this figure, the arched portion 321 of second strip member 32 is slidably passed through the longitudinal slot 241 of the bottom rectangular plate 21.

Figure 5:
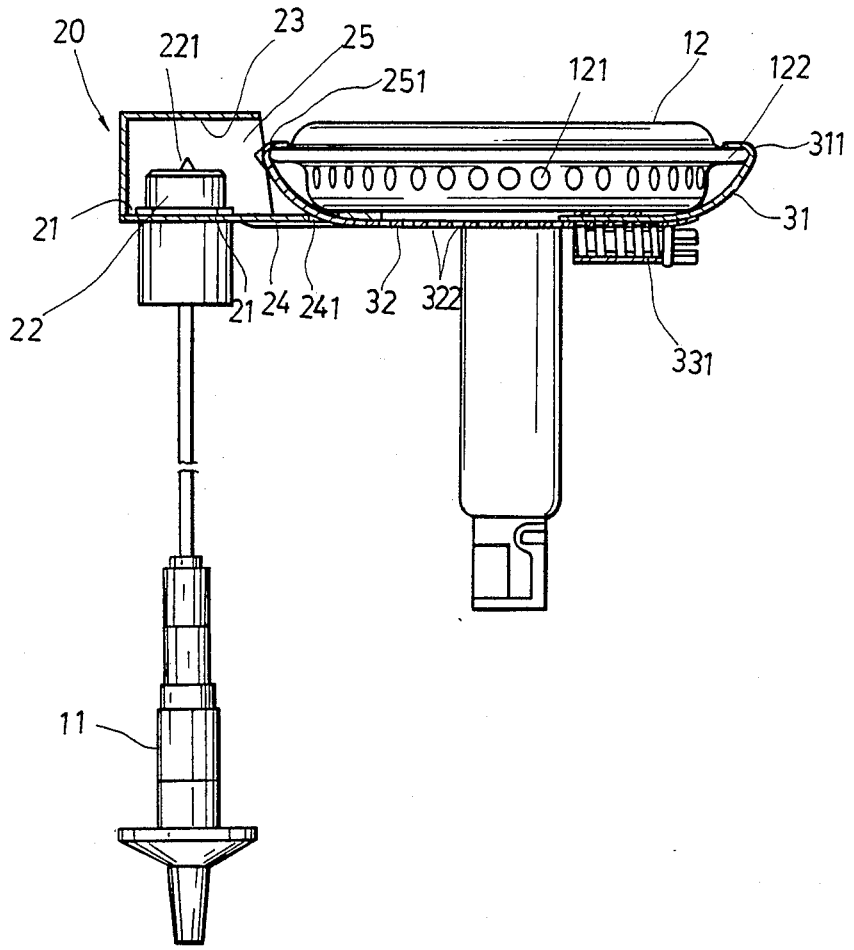
FIG. 5 illustrates the preferred use of the invention.

FIG. 5 shows the embodiment assembled to a gas burner. The electrode 22 is connected to a spark generator 11. The gas burner casing 12 has a flange member 122 formed in its peripheral outer edge. The flame holes 121 are formed under the flange member 122 to prevent oil from dripping into the flame holes during barbecuing, etc. The two arched ends 311, 321, positioned opposite to each other, are clamped to the flange member 122. The screw member 34 is then communicated with the slots 322 to fasten the two strip members 31, 32 in this position. The V-shaped notches 251 engage with the flange member 122 to prevent any unforced upward or downward movement of the housing 20. When the gas burner is turned on, the housing 20 collects some of the gas released through the flame holes 121 such that combustion results when the spark generator 11 generates a spark at the electrode tip 221.

The adjustable feature of the fastening means 30 allows the ignition device to be compatible with gas burners of various shapes and sizes. The housing 20 can be tilted to enable the electrode tip 221 to come into closer contact with the flame holes 121, thereby expediting the combustion process of the gas burner 12.

While the invention has been described in connection with what is considered the most practical and preferred embodiment, it is understood that the invention is not limited to the disclosed embodiments, but is intended to cover various arrangements included within the spirit and scope of the broadest interpretation so as to encompass all such modifications and equivalent arrangements.

I claim:

1. An improved ignition device for a gas burner having a burner casing with at least one flange member outwardly and radially extending from the burner casing and a plurality of flame holes below said flange member, said ignition device including an electrode, a spark generator for inducing a spark in said electrode, a housing for said electrode, a fastening means for fixing said housing to the gas burner, and improvements, wherein :

said housing includes a top plate, a bottom plate with a mounting hole for said electrode, and a pair of side plates on two opposing sides of said bottom plate, each of said side plates having an edge with a notch formed thereat, said notches of said side plates being adaptable to engage with the flange member.

2. An improved ignition device as claimed in claim 1, wherein said bottom plate is extended with respect to the top plate and has a longitudinal slot formed on said extended portion.

3. An improved ignition device as claimed in claim 2, wherein said pair of side plates each have an inclined edge with said notch formed thereat.

4. An improved ignition device as claimed in claim 3, wherein the tip of the electrode is distanced from said top plate by approximately ¼ inch for ignition efficiency.

5. An improved ignition device as claimed in claim 2, wherein said fastening means comprises a first strip member and a second strip member, each having a first end and an arched end, said first ends of said strip members slidably overlapping one another, said arched end of said second strip member being adapted to slidably pass through said longitudinal slot, said arched ends of said strip members being adapted to detachably engage with the flange member at two opposite sides of the burner casing, and adjusting means movably interconnecting said first ends of said strip members and permitting a change in distance between said arched ends.

6. An improved ignition device as claimed in claim 5, wherein said second strip member has a plurality of transverse slots provided at intervals along its length.

7. An improved ignition device as claimed in claim 6, wherein said adjusting means comprises a substantially cylindrical screw housing; a substantially rectangular strip housing with said first end of said first strip member fixed to said strip housing, and said first end of said second strip member sleeved on said strip housing thereby allowing said second strip member to move relative to said strip housing, said strip housing being connected along a common wall to said screw housing; an axial opening provided on said common wall; and a screw member extending longitudinally relative to said second strip member in said strip housing and having a screw thread adjustably engaged with said transverse slots through said axial opening.

* * * * *